US005246080A

United States Patent [19]

Horvei et al.

[11] Patent Number: 5,246,080

[45] Date of Patent: Sep. 21, 1993

[54] HIGH PRESSURE CONVERTER FOR DEEP WELL DRILLING

[75] Inventors: Kunt Horvei, Sandnes; Idar G. Johnsen, Gausel, both of Norway

[73] Assignee: Den norske stats oljeselskap a.s., Stavanger, Norway

[21] Appl. No.: 849,376

[22] PCT Filed: Oct. 31, 1990

[86] PCT No.: PCT/NO90/00164

§ 371 Date: May 6, 1992

§ 102(e) Date: May 6, 1992

[87] PCT Pub. No.: WO91/07566

PCT Pub. Date: May 30, 1991

[30] Foreign Application Priority Data

Nov. 8, 1989 [NO] Norway ..... 89.4436

[51] Int. Cl.[5] ..... E21B 4/02

[52] U.S. Cl. ..... 175/93; 175/107; 175/324

[58] Field of Search ..... 175/38, 65, 93, 105-107, 175/324

[56] References Cited

U.S. PATENT DOCUMENTS

| | | | |
|---|---|---|---|
| 3,112,800 | 12/1963 | Bobo | 175/67 |
| 3,897,836 | 8/1975 | Hall et al. | 175/93 |
| 4,047,581 | 9/1977 | Erickson | 175/95 |
| 4,187,061 | 2/1980 | Jürgens | 175/107 |
| 4,200,158 | 4/1980 | Perkins | 175/297 |

FOREIGN PATENT DOCUMENTS

| | | |
|---|---|---|
| 0131451 | 1/1985 | European Pat. Off. . |
| 0335543 | 10/1989 | European Pat. Off. . |
| WO83/00183 | 1/1983 | World Int. Prop. O. . |

*Primary Examiner*—Ramon S. Britts
*Assistant Examiner*—Frank S. Tsay
*Attorney, Agent, or Firm*—Foley & Lardner

[57] ABSTRACT

A pressure converter for a drill pipe includes a housing with a header channel therein which is in communication with a drill bit, a drive unit which is driven by a driving drilling fluid flow of the drill pipe, a valve which is operatively connected to and moved by the drive unit, a piston which moves in a reciprocating manner thereby creating a pressure stroke and a return stroke, and a check valve through which a portion of the drilling fluid flow is discharged to the drill bit via the header channel. The reciprocating movement of the piston is controlled by the valve and the piston includes a first piston area which is subjected to the driving drilling fluid flow during the pressure stroke and which is in communication with a returning drilling fluid flow running outside the drill pipe, a second piston area which is opposite the first piston area and which is in communication, during the pressure stroke and the return stroke, with the returning drilling fluid flow, and a third piston area which is opposite to and smaller than the first piston area, and which 1) during the pressure stroke, generates an increased pressure in a portion of the driving drilling fluid flow, and 2) is in communication with the driving drilling fluid flow during the return stroke. The increased pressure portion of the driving drilling fluid flow is discharged via the first check valve and the header channel to the drill bit.

20 Claims, 7 Drawing Sheets

HIGH PRESSURE CONVERTER FOR DEEP WELL DRILLING

FIELD OF THE INVENTION

This invention relates to a pressure converter for mounting above the drill bit at the lower end of a drill pipe for deep drilling, in particular for oil and gas, for the purpose of generating an increased fluid pressure by utilizing energy in a drill fluid flow downwards through the drill pipe.

DESCRIPTION OF THE RELATED ART

Various proposals are previously known for such utilization of the drill fluid flow, in particular in order to obtain an enhanced or more efficient drill operation. An example of such known techniques is to be found in the international patent application, PCT/EP82/00147. This example relates to the employment of an impact effect brought about with the drill fluid flow as a source of energy, so as to enhance the drilling action.

SUMMARY OF THE INVENTION

Of particular interest to the present invention is the employment of one or more high pressure jets adapted to make the drilling more effective by providing a cutting action in a surrounding rock formation, which is previously known per se. The invention, however, is directed to a novel design of a pressure converter for generating the required high fluid pressure.

What is novel and specific to the pressure converter according to the invention in the first place, consists therein that drive means is adapted to be driven by the drill fluid flow and to move valve means controlling piston means for reciprocating movement with a pressure stroke and a return stroke, said piston means having at one side a relatively large piston area adapted to be subjected to the drill fluid pressure in the drill pipe during the pressure stroke, and having at the other side a first, opposite piston area which both during the pressure stroke and the return stroke is subjected to the return pressure in the drill fluid flow upwards outside the drill pipe, and a second, opposite and relatively small piston area which during the pressure stroke is adapted to provide an increased pressure in a smaller proportion of the drill fluid flow, whereby a check valve provides for discharge of this smaller proportion of the flow to a header channel leading forwards to the drill bit, whereas the large piston area during the return stroke is adapted to be subjected to the return pressure outside the drill pipe and the small piston area to the pressure in the drill pipe.

As a typical example it may be mentioned that the pressure in the drill fluid flow which is employed, can be about 200–300 bar, whereas the smaller flow which is converted can obtain an increased pressure of for example 1500–2000 bar. (When here and in the following description examples of figures referred to pressure magnitudes are given, these are in the principle relative magnitudes, i.e. pressure differences, since the static pressure determined by the depth concerned has been neglected.) The resulting high pressure fluid is led to nozzles in the drill bit, from which it is emitted in the form of powerful jets being able to cut into the surrounding rock and thereby release stresses in underlying masses. This facilitates the drilling operation and speeds up the drilling.

In the new pressure converter described here it may be an advantage to provide a spring for assisting at least initially during the return stroke, preferably a compression spring which acts against the first, opposite piston area.

Moreover, the piston member can be freely movable in its axial direction under the influence of the drill fluid and spring pressures mentioned, and besides the reciprocating movement of the piston preferably takes place in the longitudinal direction of the drill pipe.

In most applications it is preferred, according to the invention, that the header channel for the high pressure flow is arranged to be through-going from one to the opposite end of the pressure converter, in order to make possible a coupling to similar pressure converter units at both ends, so that there is formed a common header channel for several pressure converter units constituting a group, for example consisting of 15 to 20 units. This will increase the total capacity in providing the desired high pressure fluid flow. Moreover, there is obtained a substantial advantage by phase-shift of the pressure strokes in the individual units in such a group, in order thereby to obtain a total, smooth high pressure flow. Finally, it is an advantage with such a group arrangement that in the case of failure in one or a small number of pressure converter units, the remaining units in the group will be able to supply a sufficient amount of high pressure fluid for the application concerned. In other words, the pressure converter units in the group are standing in a parallel relationship to each other with respect to the drill fluid flow.

The pressure converter according to the invention will be able to operate exclusively under the direct influence or control through the normal fluid flow from pumps at the top of the drill string, so that it is not necessary to provide specific control systems or connections in order to regulate the generation of the desired high pressure flow of drill fluid. By increasing the pressure, the velocity and/or the amount of drill fluid being supplied by the pumps, the pressure converter units will give a high pressure flow having a larger or smaller magnitude, and a higher or lower pressure respectively. Commonly employed means for controlling the drill fluid flow downwards from the top of the drill string, will be useful in this connection. The drill fluid from the pumps which typically provide a pressure of 200 to 340 bar, thus, flows downwards within the drill string or the drill pipe, whereby a main portion is led directly to the drill bit, whereas a smaller proportion of the drill fluid flow passes through the pressure converter units for conversion to the desired higher pressure.

BRIEF DESCRIPTION OF THE DRAWINGS

The invention shall be explained more closely in the following description, with reference to the drawings, in which.

DETAILED DESCRIPTION OF THE PREFERRED EMBODIMENT

Figure 1:
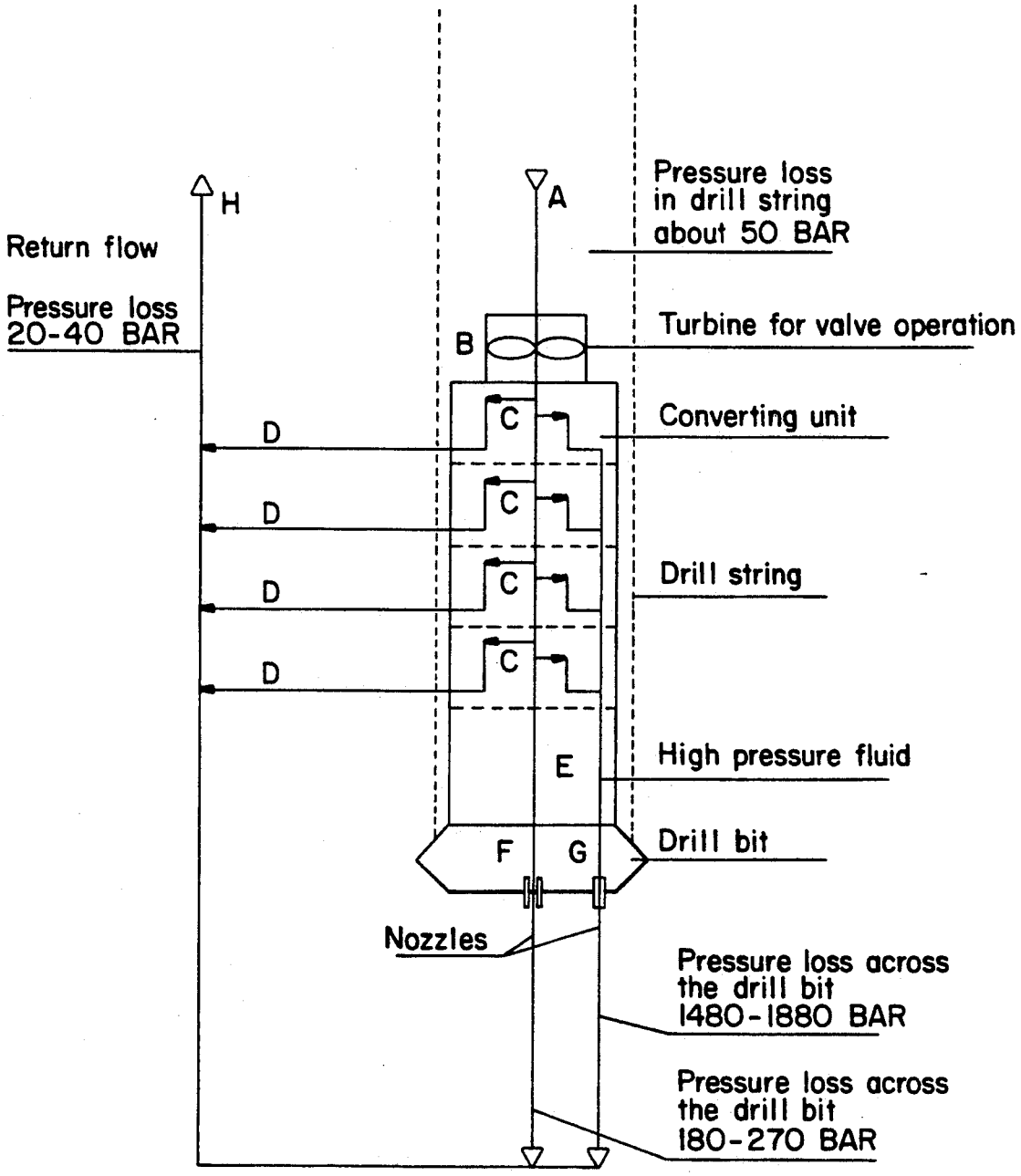
FIG. 1 is a highly schematic flow diagram showing, among other things, typical pressure relationships in connection with a drill string provided with pressure converters according to the invention.

Main features of what takes place in a drill string and accompanying typical examples of pressure relationships when using pressure converters according to the invention for conversion from fluid having a relatively low pressure of about 200 to 340 bar to a smaller amount of fluid having a high pressure of about 1500 to 2000 bar (relative magnitudes), are shown in FIG. 1.

A fluid flow A comes from a pump system resulting in a pressure of about 200 bar and a maximum of 340 bar, and an amount of about 2000 to 4000 liters per minute, depending upon the length of the drill string and the capacity of the system. The drilling fluid enters a pressure converter group having four units, where it passes by a turbine B for valve operation. There is an estimated to be a pressure drop of about 50 bar when passing through the drill string and the turbine.

The drilling fluid is subdivided into two flows. One of about 400 to 600 liters per minute goes through the pressure converters, whereas the remaining part goes through the system to the drill bit where, because of jet nozzles, there is a pressure drop of about 180 to 270 bar. After passage by the drill bit there is a return flow H having a pressure drop of about 20 bar before the drilling fluid returns to the drilling module at the top of the drill string, where the flow in the usual manner is led into an open tank (1 bar). In each pressure converter the fluid flow C will perform its work by increasing the pressure in a smaller proportion of the drilling fluid, and thereby the pressure in this flow drops from about 200 to 290 bar to about 20 bar. Then the flow passes through a tube D and out into the return flow H, which runs at the outside of the drill string or pipe inside the usual casing and at pressure of about 20 to 40 bar.

The smaller portion of the fluid flow to which energy has been added, has been subjected to a pressure increase from about 200 to 290 bar to about 1500 to 2000 bar. This fluid flow is now led through a channel system E down to the drill bit. In parts of the drill bit there are mounted specific high pressure nozzles which make it possible to "cut" into the formation. The counter-pressure is the same as for the drilling fluid, about 20 bar, and there is a pressure drop across these nozzles of about 1500 to 2000 bar minus 20 bar, which gives about 1480 to 1980 bar. The flows F and G combine and convey crushed and loose particles to the surface, i.e. flows F and G are incorporated into the total return flow H.

Figure 2:
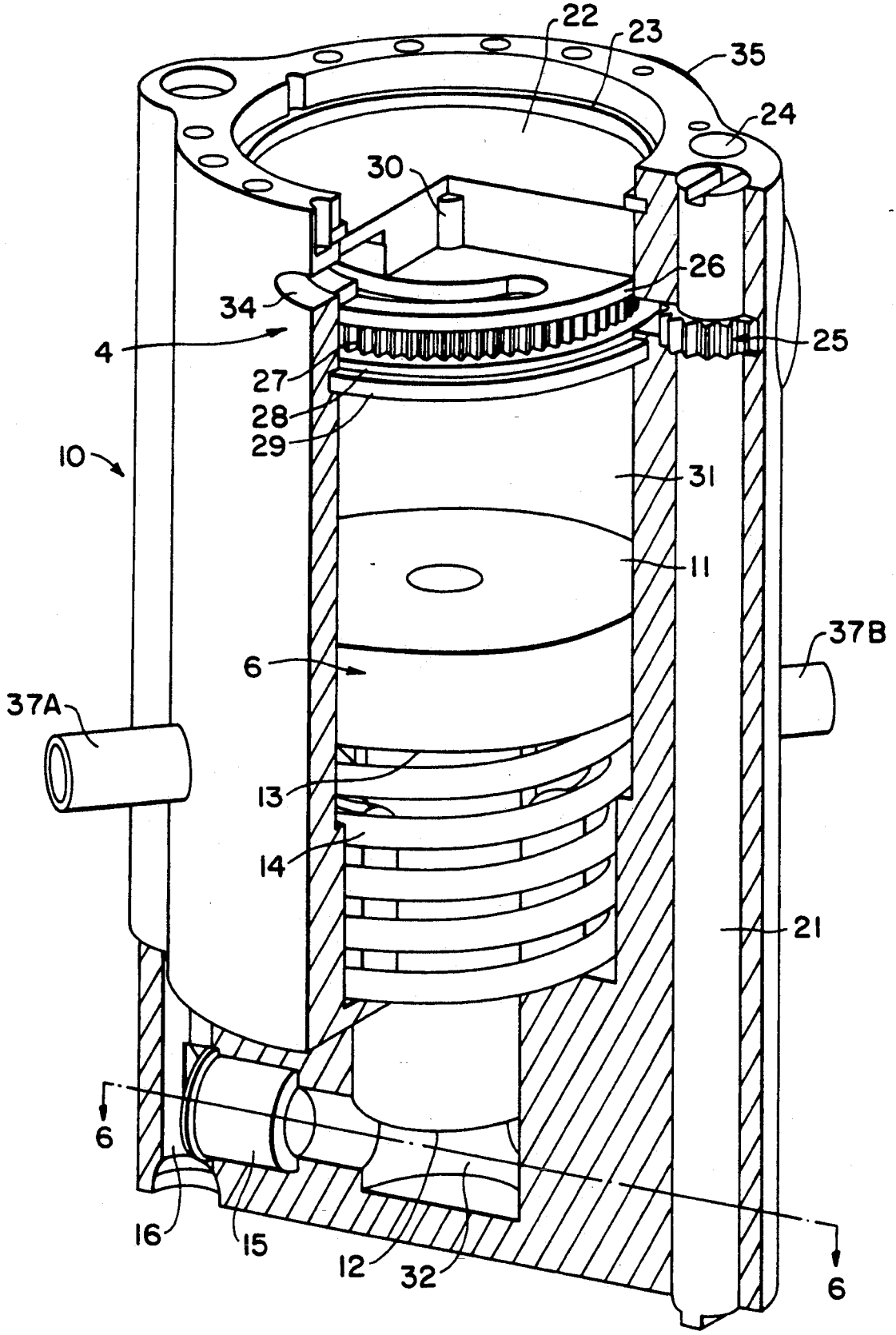
FIG. 2 shows in partial cross-section a practical embodiment of a pressure converter according to the invention.

The embodiment shown in FIG. 2 in the first place comprises a generally cylindrical housing 10 adapted to receive a piston 6 which has three operative piston areas, namely an upper, relatively large piston area 11, a first, opposite piston area 13 and a second opposite and relatively small piston area 12 at the lower end of piston means 6. The piston 6 is adapted to be freely movable axially under the influenee of varying drilling fluid pressures on the respective piston areas, as well as under the influence of a compression spring 14 engaging the piston area 13.

As will appear from the following description, the space or volume 31 above piston area 11 can be denoted a low pressure space, whereas volume 32 below piston area 12 correspondingly can be denoted high pressure space. Through a check valve 15 this latter space is connected to a header channel 16 for the resulting drilling fluid flow at an increased pressure. The channel 16 runs through the housing 10 in the whole longitudinal direction thereof for the purpose of interconnecting several such pressure converter units to a group. Such a group arrangement shall be discussed more closely below with reference to FIGS. 7 and 8.

Figure 5:
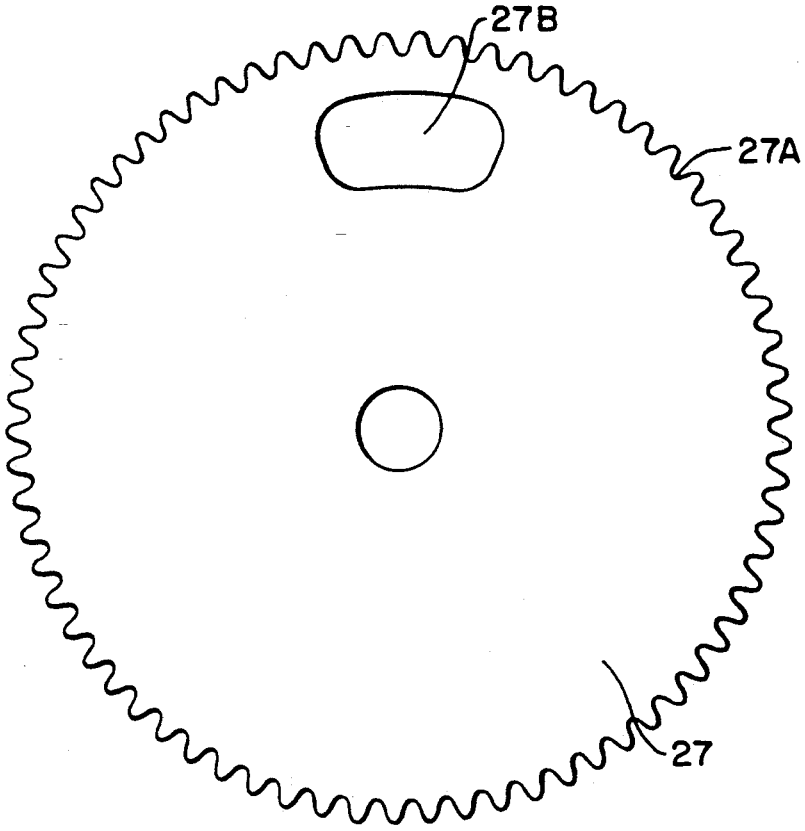
FIG. 5 shows in plane view a plate shaped valve member incorporated into the pressure converter unit in FIG. 2.

Diametrically opposite in relation to the header channel 16 there is also through the whole length of housing 10 provided a widened wall part having a bore for a through-going drive axle 21 which at its ends has means intended for coupling to corresponding pressure converters at both ends. The drive axle has a small gear 25 which via a second (not shown) small gear on an axle 24, serves to rotate a valve member in the form of a round plate 27 having teeth around its circumference as shown more clearly in FIG. 5. During operation of the pressure converter, the valve plate 27 is adapted to rotate continuously about the longitudinal axis of the pressure converter unit, which axis normally will coincide with the axis of the drill pipe in which the pressure converter is mounted.

The valve plate 27 mentioned above constitutes an essential component of valve means which serve to direct a portion of the drilling fluid flow into and out of the space 31 above the piston area 11. This valve, moreover, at the top of housing 10 comprises a cover 22 which has two channels positioned substantially opposite to each other, i.e., an inlet channel 34 and and outlet channel 35, both of which continue through the piston housing wall, as seen at 34 in FIG. 2. The cover 22 is also shown more in detail in FIG. 4. See also FIG. 3 as far as the extension of channels 34 and 35 through the piston housing wall is concerned. Further radially out from channel 35 the outlet continues through a short tube (not shown) to the annulus for the return flow between the drill string or tube and the casing.

The inlet channel 34 in cover 22 leads inwards to an arcuate slit 22A, whereas the outlet channel 35 in a corresponding manner communicates with an arcuate slit 22B. Both slits are open downwards in order to cooperate with a through-opening 27B in valve plate 27 during rotation thereof.

It may be an advantage to provide a bearing plate 26 having similar slits as in the cover, between valve plate 27 and cover 22. A similar bearing plate or sealing plate 28 is mounted underneath valve plate 27 and has corresponding arcuate slits as in plate 26 and cover 22. The complete valve means with cover 22 on top and sealing plate 28 at the bottom, is maintained in place first by an upper locking ring 23 and second by a lower locking or sealing ring 29. Besides, there is shown a central bolt at 30, which among other things constitutes the axle for the rotation of valve plate 27, whereas the other plates in the valve means are stationary. The various plates incorporated in the valve design can be made of different materials, but in order to withstand the tough environment which is represented by the circulating drilling fluid, it may be an advantage to employ high quality materials, possibly in the form of surface coatings, for example ceramic materials, which in particular can be of interest for the two bearing plates 26 and 28.

Figure 3:
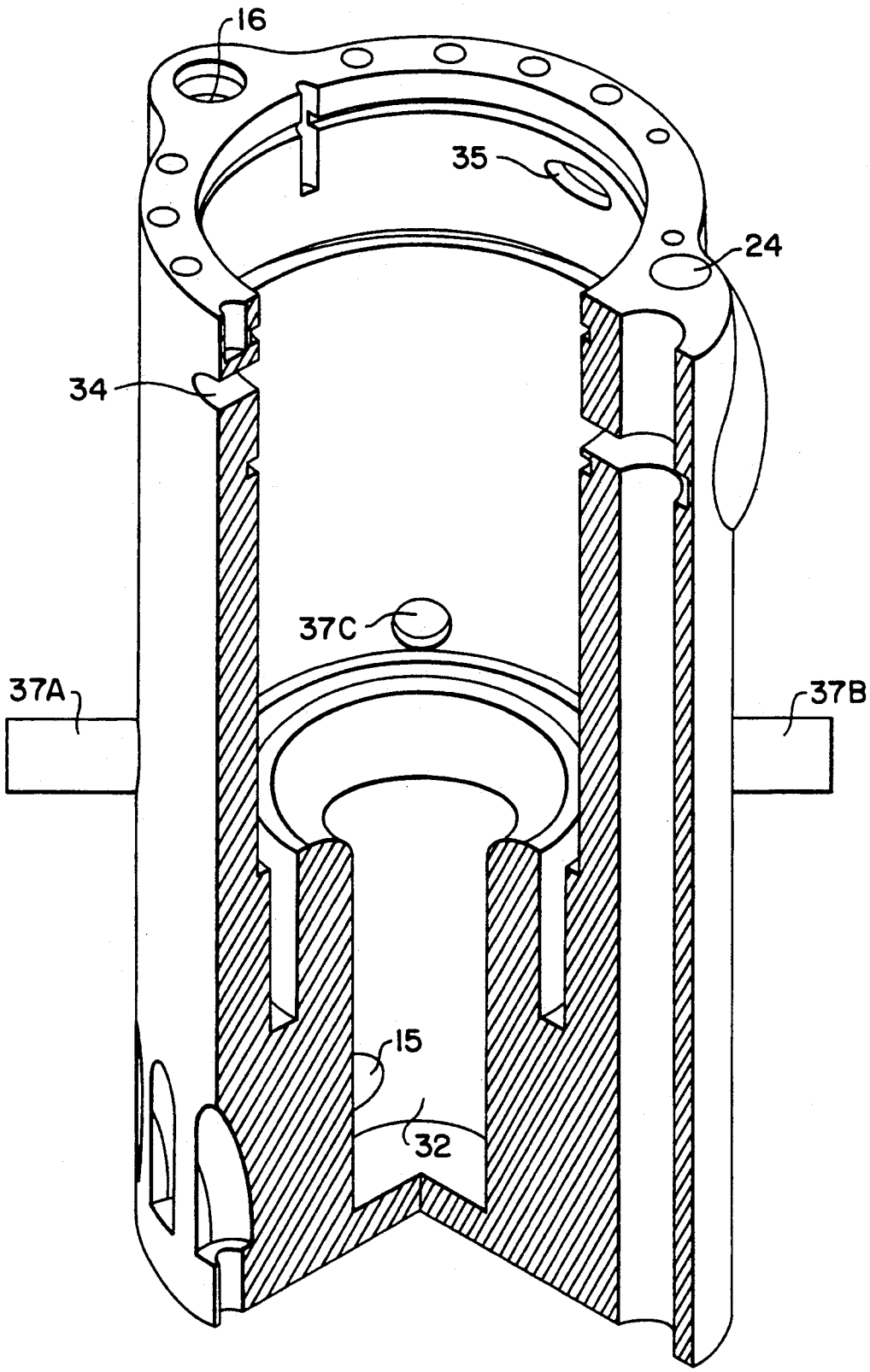
FIG. 3 shows the pressure converter of FIG. 1 with internal parts, including movable parts removed, FIG. 4 in partial cross-section shows a cover being provided at the top of the converter unit in FIG. 2.
Figure 4:
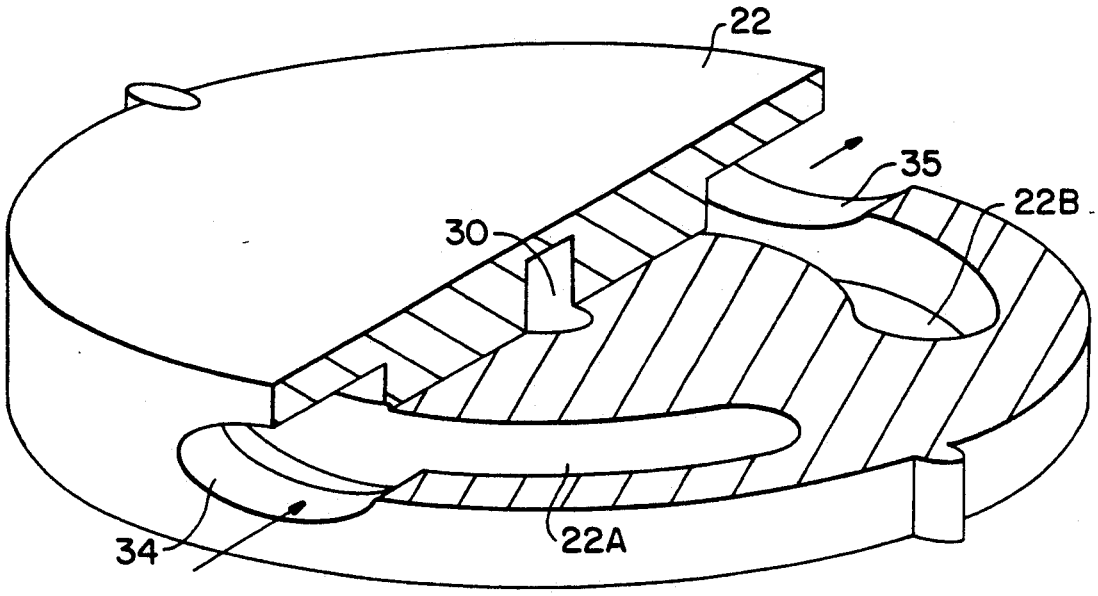

In FIGS. 2 and 3 there are further shown (three of a total of four) short tubes or connections 37A, 37B and 37C for putting the space above the first, opposite piston area 13 in fluid communication with the return passage-way for the upwardly running drilling fluid in the annulus between the drill tube or string and the well casing. Thus, the space in front of piston area 13 will all the time be subjected to a relatively low drilling fluid pressure.

Figure 6:
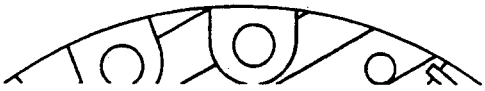
FIG. 6 shows a cross-section according to the line A—A in FIG. 2.
Figure 6:
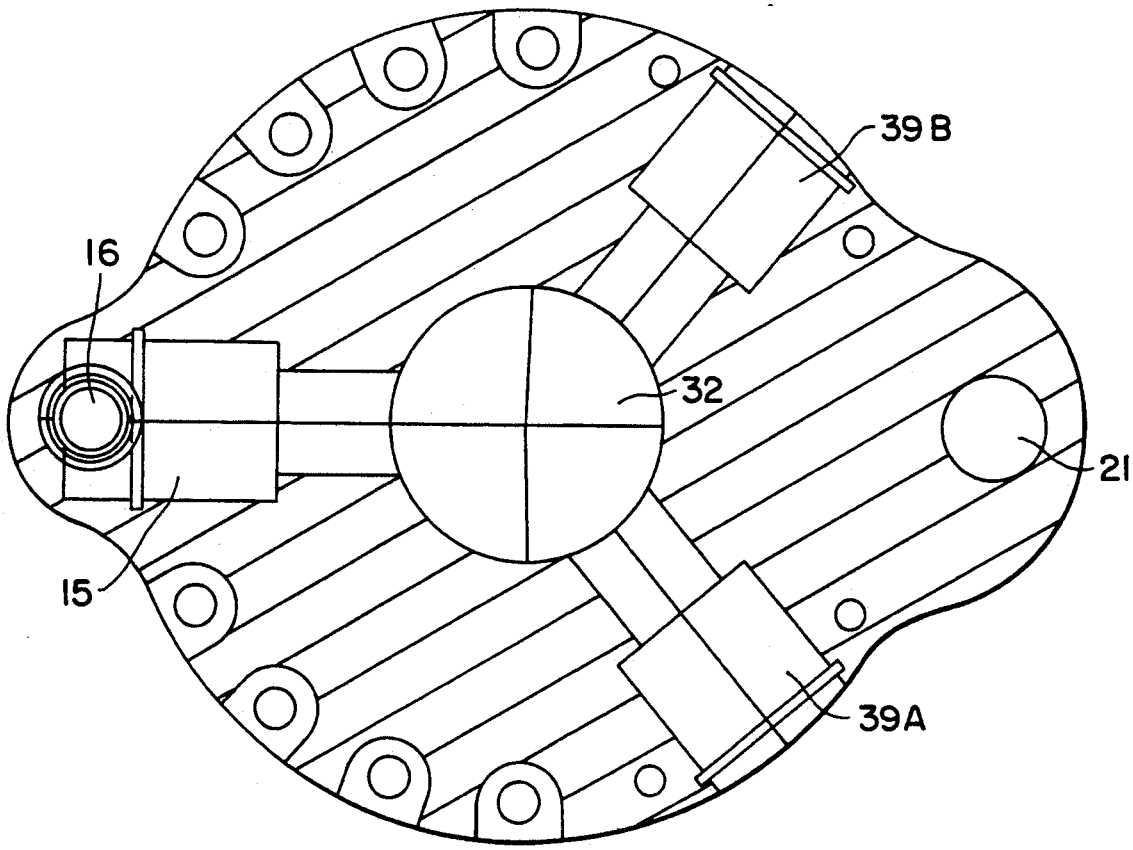

The cross-section in FIG. 6 shows in more detail the high pressure space 32 which in addition to an outlet through the check valve 15 to header channel 16 for high pressure fluid, has two inlets with respective associated check valves 39A and 39B which makes possible inflow of drilling fluid from the main flow thereof inside the drill pipe.

The operation of the pressure converter as described is as follows:

Starting from an upper dead-point of the piston 6 a pressure stroke in the downward direction is performed when the through-opening in valve plate 27 moves underneath inlet slit 22A in valve plate 22, whereby drilling fluid at a pressure of about 200 to 300 bar enters through inlet channel 34 and exerts a downwardly directed drive force on piston area 11. The opposite piston area 13 is subjected to a much lower pressure, typically about 20 to 40 bar, whereas spring 14 can have a pushing force of for example 2 to 400 kg. The driving force downwards at the upper side of the piston 6, however, will override the counterforce at the underside and will bring about the desired pressure stroke. During this downward movement drilling fluid in front of the opposite piston area 13 will be pressed out through tube connections 37A, 37B and 37C at the same time as spring 14 is compressed and partly received in the annular recess in which the spring is held. An abutment at the top of the recess (see FIG. 3) can serve to limit the maximum downward movement in the pressure stroke.

The intended buildup of a high pressure takes place in space 32 in front of the small piston area 12 at the bottom of the converter unit, and drilling fluid under high pressure is pressed out through check valve 15 to the header channel 16.

The angular extension and the separation of the two separate slits 22A and 22B in cover 22, as well as the associated slits positioned essentially quite correspondingly in the bearing plate 26 and 28, together with the design of through-opening 27B in valve plate 27, determine the development of the pressure stroke described above and the development of a return stroke which brings the piston means from the bottom position or the lower deadpoint in an upward direction towards the top position which is the starting point of the pressure stroke.

The return stroke is initiated when the opening 27B in the valve plate 27 through the outlet channel 35 puts the space 31 in communication with the annulus between the drill tube and the casing, i.e., with the mentioned much lower pressure in the return flow of drilling fluid. Then, in the first place the pressure on piston areas 11 and 13 will be equal, and the compression spring 14 provides for initiating the upward movement of the piston means. At this phase there will still exist a relatively high pressure in space 32 in front of the small piston area 12, typically a pressure somewhat below 1500 bar, which also contributes to the upward piston movement. Valve 15 will close for the established high drilling fluid pressure in header channel 16. As the piston moves upwards space 32 will expand and inlet valves 39A and 39B (FIG. 6) will open for the drilling fluid pressure in the drill pipe, typically about 200 to 300 bar. This will also contribute to the total upwardly directed pushing force. During this return stroke there will be an inward drilling fluid flow through tube connections 37A, 37B and 37C into the space in front of piston area 13.

In connection with the operation as described here, it will be realized that the spacing between the ends of through-slits 22A and 22B and the corresponding slits in plates 26 and 28, must be sufficiently large in relation to the size of opening 27B in valve plate 27, in order to prevent any direct through-flow or "short circuit" from the high drilling fluid pressure to the return flow pressure.

Figure 7:
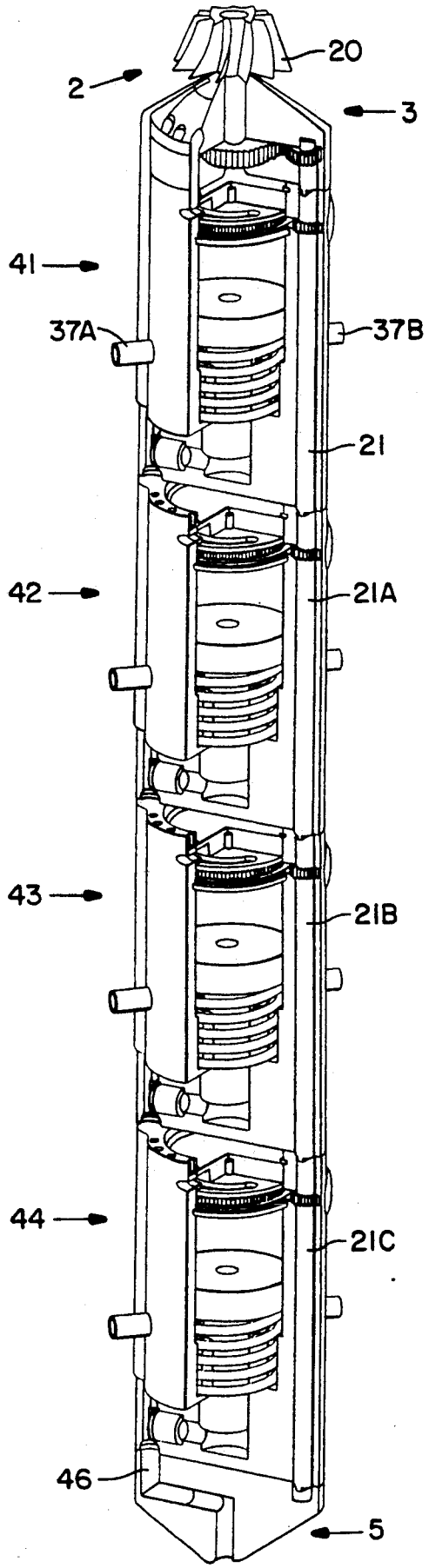
FIG. 7 shows an assembly of four pressure converter units according to FIG. 2, in a group provided with a top piece and a bottom piece, FIGS. 8A and 8B more in detail show the top and the bottom of the group in FIG. 7 when mounted in a drill pipe.
Figure 8A:
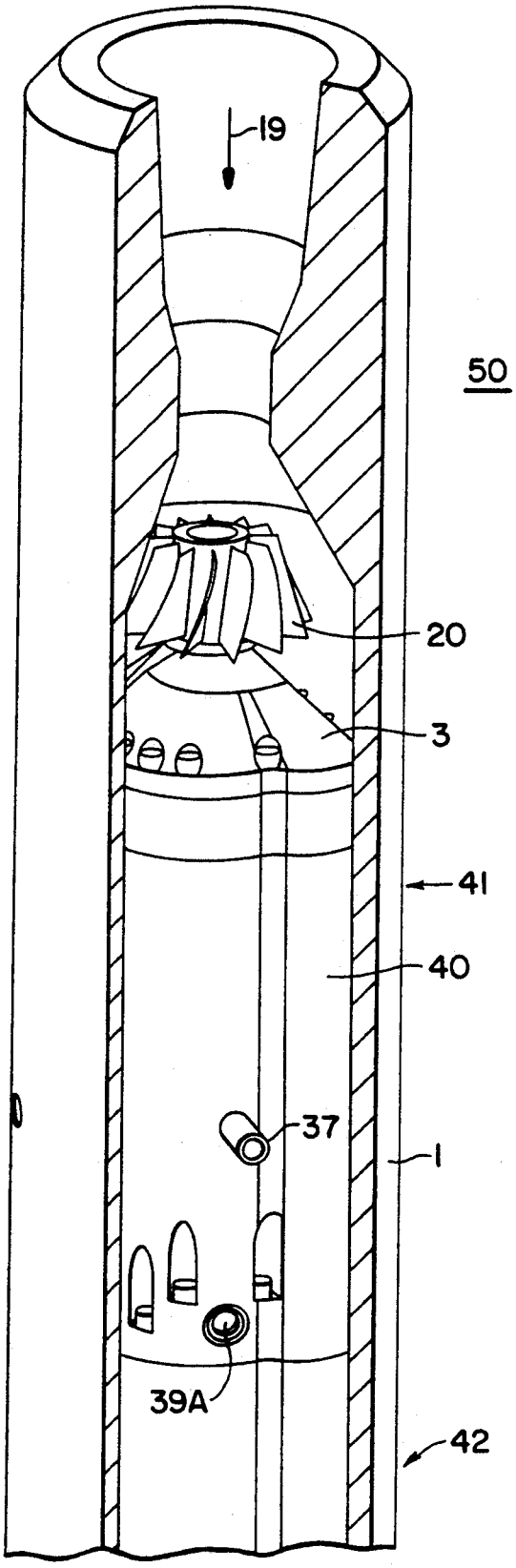
Figure 8B:
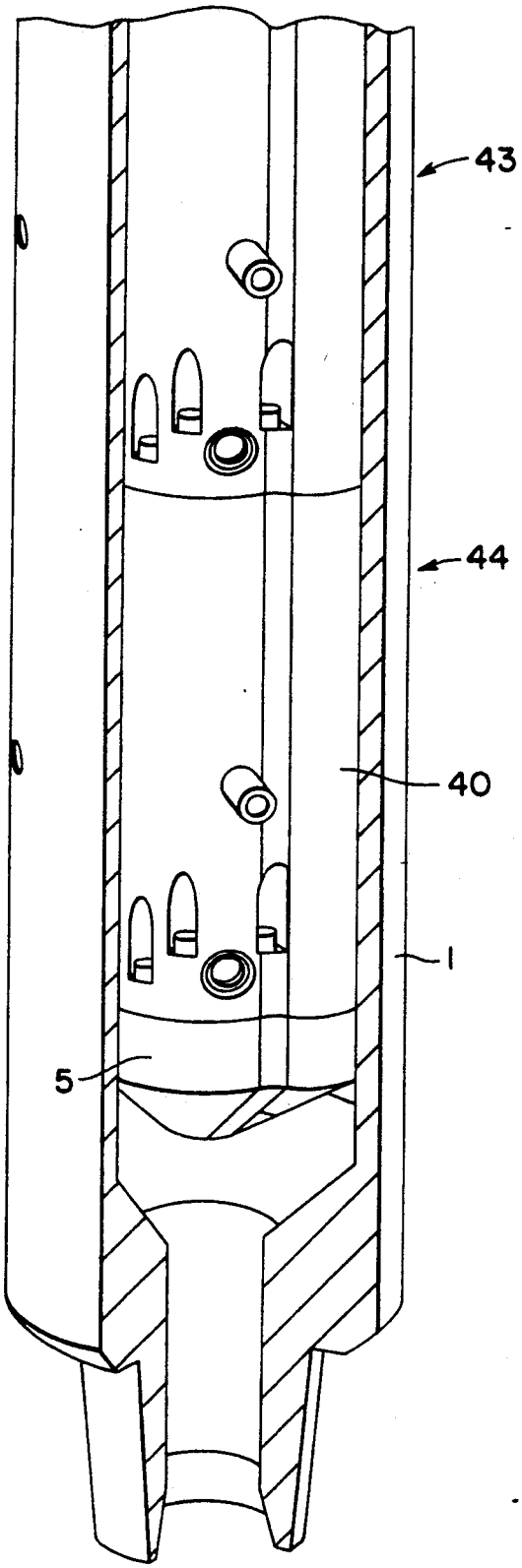

Above there has been described a single pressure converter unit and the operation thereof. With reference to FIGS. 7 and 8 it shall now be explained how such converter units can be assembled into a group, inter alia for obtaining a total higher yield or capacity.

FIG. 7 shows four pressure converter units 41, 42, 43 and 44 being coupled together end to end in the longitudinal direction, with a top piece 3 mounted on unit 41, whereas a bottom piece 5 is mounted on unit 44. At converter unit 41 there are indicated short tubes 37A and 37B as in FIGS. 2 and 3, as well as the drive axle 21 which is rotationally coupled to the drive axle of the remaining units, i.e., axles 21A, 21B and 21C respectively.

The top piece 3 carries drive means in the form of a turbine 20 adapted to be driven by the drilling fluid flow, whereby a gear transmission conveys the power from the turbine axle to the assembled drive axles for rotating these in common and thereby provide for the intended control of the valve means in the converter units. It is an advantage to have these phase shifted, i.e., with mutual angular displacement, so that the pressure strokes and thereby the high pressure output from each of the units to the common header channel are smoothed to a more constant high pressure flow than will result from each individual pressure converter. At 46 the header channel is extended into the bottom piece 5 which has a central outlet for further fluid flow to the region at the drill bit (not shown).

The assembled group of pressure converters is mounted free-standing in the drill pipe supported by the bottom plate. FIG. 8 shows some details in this connection, at the top and the bottom of the group respectively. Converter units 41 and 44 are shown completely, whereas units 42 and 43 are shown only in part. The surrounding drill pipe 1 forms an annular fluid passageway 40 outside and surrounding the pressure converter units in the group, so as to make possible a normal movement of the main portion of the drilling fluid flow down to the drill bit. The total drilling fluid flow from above is indicated with arrow 19 in FIG. 8A. Through a narrowed inlet part at the inside of drill pipe 1, the drilling fluid flow is led against an impeller 20 located upstream in relation to the converter group. The previously recited short tubes or tube connections out to the annulus outside the drill pipe 1, of which a tube 37 is indicated in FIG. 8A, as the case may be can contribute to the anchoring and aligning of the whole converter group within drill pipe 1. This annulus for the return flow of drilling fluid is indicated by reference numeral 50.

Even though each individual pressure converter alone can have a too small capacity with respect to its discharge of high pressure fluid, in relation to the actual requirement, the assembly into groups as discussed above will make it possible to obtain a sufficiently large combined yield. Each individual pressure converter unit will have a capacity (liters per minute) which also depends upon the stroke rate of the piston means. A factor in this connection, and of significance for the operation as a whole, is that the turbine 2 with its impeller 20 is not required to have any particularly high power output, since the purpose thereof only is to move the valve means which controls the drilling fluid flows into and out of the piston means, which is the part of the structure which must have comparatively high power capacity.

An assembled group of for example 15 to 20 converter units in practice can have a total length of about 6 meters and can be mounted free-standing on a bottom piece within a section of drill pipe or drill string having a corresponding length, possibly with strut elements between the inside of the drill pipe or string and the pressure converter units. For additional increase of capacity, several such sections or lengths of about 6 meters can be interconnected.

Since there is no need for any direct connection from the pressure converters to the surface, for example a drill rig, apart from the drilling fluid flow which is supplied by the common drilling fluid pumps, the control and regulation of the pressure converting operation must be built up with due consideration thereof. A relatively important factor in this connection is the pressure drop across the drill bit during operation. Prior to a drilling operation with accompanying generation of high pressure drilling fluid as described above, it will be near at hand and normal to carry out the following:

Adjustment of permanently mounted nozzles in the drill bit for determining the pressure drop depending on the drilling fluid flow to pass by.

Adjustment or setting of pressure drop in the drilling fluid supply to the pressure converters as well as the pressure drop in the return flow of drilling fluid.

Pressure drop across the turbine which provides for valve movement.

Variable parameters which have influence on the pressure conversion process are the flow velocity and volume as well as the pressure. The return pressure may also be a parameter which it is desirable to vary in order to control the process in the converter units.

Theoretically one should be able to determine the pressure increase and the volume in the fluid converter by proceding as follows:

By increased velocity of the fluid the turbine for valve operation will have an increased rate of rotation, and the same applies to the rate of alternations in the valve system. This will increase until reaching a maximum for input or output respectively of fluid in the individual units and piston movement.

By increasing or reducing the pressure from the pumps the pressure drop across the drill bit will increase or decrease respectively, and thereby the resulting pressure in the high pressure fluid supplied, will increase or decrease respectively.

Even though the pressure converter described is primarily intended for supplying high pressure fluid to jet nozzles for cutting in rock, there are also possibilities of different applications of such drilling fluid under an increased pressure, for example for driving particular drilling devices.

Among possible modifications within the framework of the invention, it is mentioned that the cooperating openings and slits in the valve member, bearing plates and cover can be arranged "inversely" in relation to the example shown, i.e. with a small angular extension of the slits in the cover and the bearing plates, whereas the opening in the valve member can have a more extended slit shape with a larger angular extension about the central axis.

We claim:

1. A pressure converter for a drill pipe having a drill bit, the pressure converter comprising:

a housing including a header channel in communication with the drill bit;

a drive unit which is driven by a driving drilling fluid flow of the drill pipe;

a piston which moves in a reciprocating manner thereby creating a pressure stroke and a return stroke, said piston including a first piston area which is subjected to said driving drilling fluid flow during said pressure stroke and which is in communication, during said return stroke, with a returning drilling fluid flow running outside the drill pipe, a second piston area which is opposite to said first piston area and which is in communication with, during said pressure stroke and said return stroke, the returning drilling fluid flow, a third piston area which is opposite to and smaller than said first piston area and which 1) during the pressure stroke, generates an increased pressure in a portion of the driving drilling fluid flow, and 2) is in communication with the driving drilling fluid flow during the return stroke, a valve which is operatively connected to and moved by said drive unit, said valve controlling the reciprocating movement of said piston, and a first check valve through which said portion of the drilling fluid flow is discharged to the drill bit via said header channel.

2. A pressure converter according to claim 1, further comprising a spring which exerts a force against said piston to assist movement of said piston during at least a portion of said return stroke.

3. A pressure converter according to claim 2, wherein said spring is a compression spring.

4. A pressure converter according to claim 1, further comprising at least a second check valve, and wherein said housing has a first space therein which is located below said third piston area and which is connected to a fluid passageway of the drill pipe via said second check valve, and said driving drilling fluid flows through said fluid passageway.

5. A pressure converter according to claim 1, wherein said piston is freely moveable along its longitudinal axial direction due to a pressure of the driving drilling fluid flow.

6. A pressure converter according to claim 1, wherein said reciprocating movement of said piston is along the longitudinal direction of the drill pipe.

7. A pressure converter according to claim 1, wherein said header channel extends from a first end of said housing to a second end of said housing such that said housing can be coupled at said first and second ends to additional pressure converters, whereby said header channel and corresponding header channels of said additional pressures converters form a common header channel.

8. A pressure converter according to claim 1, further comprising a plurality of tube connections, and wherein said housing includes a second space below said second piston area, and said plurality of tube connections each extend from said second space to an annulus outside of the drill pipe thereby at least partially anchoring the pressure converter within the drill pipe.

9. A pressure converter according to claim 1, wherein said drive unit includes a turbine with an impeller, and at times when said impeller is subjected to the driving drilling fluid flow, the impeller rotates.

10. A pressure converter according to claim 1, further comprising a drive axle which extends through a wall of said housing and which is capable of being coupled to a corresponding drive axle of another pressure converter, and wherein said drive axle moves said valve.

11. A pressure converter according to claim 1, wherein said valve includes a plate shaped member having a central axis about which it rotates, said central axis coinciding with a longitudinal axis of the drill pipe.

12. A pressure converter according to claim 11, wherein said valve member includes a plurality of teeth along its circumference which are rotatably connected to said drive axle.

13. A pressure converter according to claim 12, further comprising a first gear connected to said drive axle and a second gear disposed between and operationally connected to said plurality of teeth and said first gear.

14. A pressure converter according to claim 11, wherein said valve member has a through-opening therein which directs the driving drilling fluid flow from the drill pipe to said piston and returns the driving drilling fluid flow to the outside of the drill pipe.

15. A pressure converter according to claim 14, further comprising a generally plate shaped cover having a first radial channel forming an inlet, a second radial channel forming an outlet, an inlet slit in communication with said inlet, and an outlet slit in communication with said outlet, and wherein said driving fluid flow enters from the drill pipe through said inlet and said inlet slit and returns to an annulus outside of the drill pipe via the outlet slit and the outlet, and said inlet and outlet slits have an angular extension relative to the central axis which is larger than an angular extension of the through-opening of the valve member relative to the central axis.

16. A pressure converter according to claim 15, further comprising first and second wear resistant bearing plates respectively disposed on opposite sides of said valve member, said first and second wear resistent bearing plates each having through-going slits therein which respectively generally correspond to said inlet and outlet slits.

17. A pressure converter according to claim 14, further comprising a generally plate shaped cover having a first radial channel forming an inlet, a second radial channel forming an outlet, an inlet slit in communication with said inlet, an outlet slit in communication with said outlet, and first and second wear resistant bearing plates that are disposed respectively on opposite sides of said valve member, said wear resistant bearing plates each having through-going slits which respectively correspond to the inlet and outlet slits, and wherein said driving fluid flow passes through said inlet and said inlet slit and returns to an annulus outside the drill pipe via the outlet slit and the outlet, and said inlet and outlet slits and said through-going slits have an angular extension relative to the central axis which is smaller than an angular extension of the through-opening of said valve member.

18. A pressure converter according to claim 11, wherein said piston reciprocatingly moves due to varying driving drilling fluid flow pressures which ar respectively exerted on said first, second and third piston areas.

19. A pressure converter according to claim 18, further comprising a spring which assists in the reciprocating movement of said piston.

20. A pressure converter according to claim 7, wherein each of said addition pressure converters are substantially the same as said pressure converter and the reciprocating movement of the respective valves of the pressure converter and said additional pressure converters are phase shifted to smooth out a total driving drilling fluid flow through said common header channel.

* * * * *